US010040181B2

(12) United States Patent
Fu et al.

(10) Patent No.: US 10,040,181 B2
(45) Date of Patent: Aug. 7, 2018

(54) HAND-HELD POWER TOOL WITH LIGHTING ELEMENT

(71) Applicant: CHERVON INTELLECTUAL PROPERTY LIMITED, Road Town (VG)

(72) Inventors: Xiangqing Fu, Nanjing (CN); Gan Wei, Nanjing (CN); Fengqin Zhou, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 531 days.

(21) Appl. No.: 14/641,573

(22) Filed: Mar. 9, 2015

(65) Prior Publication Data

US 2015/0251299 A1 Sep. 10, 2015

(30) Foreign Application Priority Data

Mar. 7, 2014 (CN) ..... 2014 1 0082918
Mar. 7, 2014 (CN) ..... 2014 2 0104783 U

(51) Int. Cl.
*B25B 23/18* (2006.01)
*F21V 33/00* (2006.01)

(52) U.S. Cl.
CPC ..... *B25B 23/18* (2013.01); *F21V 33/0084* (2013.01)

(58) Field of Classification Search
CPC ..... B25B 23/18
USPC ..... 362/119
See application file for complete search history.

(56) References Cited

U.S. PATENT DOCUMENTS

2010/0149790 A1* 6/2010 Leong ..... B25B 23/18 362/119
2011/0188232 A1* 8/2011 Friedman ..... B25B 21/00 362/119

* cited by examiner

*Primary Examiner* — Elmito Breval
*Assistant Examiner* — Meghan Ulanday
(74) *Attorney, Agent, or Firm* — Greenberg Traurig, LLP

(57) ABSTRACT

A hand-held power tool includes a housing defining a first longitudinal axis and an illuminating assembly mounted to the housing. The illuminating assembly includes lighting elements distributed on the housing around the first longitudinal axis, a circuit board electrically connected to the lighting elements, a main body, and a fixing member. The lighting elements are supported by the circuit board. The main body partially covers the lighting elements and the circuit board. The lighting elements and the main body are fixed to the housing by the main body cooperative with the fixing member. The lighting elements are distributed around the first longitudinal axis so that light of the lighting elements can be emitted from multiple different angles, shadows are avoided in corresponding zones, and therefore the lighting elements can be called shadow-less lighting elements.

13 Claims, 11 Drawing Sheets

HAND-HELD POWER TOOL WITH LIGHTING ELEMENT

RELATED APPLICATION INFORMATION

This application claims the benefit of CN201420104783.3, filed on Mar. 7, 2014, and CN201410082918.5, filed on Mar. 7, 2014, the disclosures of which are incorporated herein by reference in their entirety.

FIELD OF THE DISCLOSURE

The present disclosure relates to power tools, and more particularly to a hand-held power tool with a lighting element.

BACKGROUND OF THE DISCLOSURE

Power tools are often used in a variety of conditions ranging from well-lit indoor work spaces to outside construction sites or other areas that are not always well-lit. Accordingly, it is desirable to provide a method or apparatus that permits a power tool to have a lighting feature that will illuminate the work-piece that is being machined or worked on by the power tool. Such a lighting feature will assist a user to be able to adequately see the work-piece or work area that is being worked on or machined by the power tool even in substandard light conditions.

In order to be used in substandard light conditions, a typical power tool includes an execution element and a lighting element. The lighting element is generally arranged between a trigger and a housing. Another typical power tool includes a lighting element arranged at edge portion of a battery pack for the power tool. However, such power tools with a lighting element are not able to clearly illuminate the execution element or the work-piece, because when a single lighting element illuminates the execution element, a shadow of the execution element is unduly formed. Since the user cannot clearly see the execution element or the work-piece in substandard light conditions, the operation of the power tool is made inconvenient.

SUMMARY

Therefore, the purpose of the present disclosure is to provide a kind of power tool which can be conveniently used even in substandard light conditions.

The present disclosure is directed to a hand-held power tool including a housing defining a first longitudinal axis and an illuminating assembly mounted to the housing. The illuminating assembly includes lighting elements distributed on the housing around the first longitudinal axis, a circuit board electrically connected to the lighting elements, a main body, and a fixing member. The lighting elements are supported by the circuit board. The main body partially covers the lighting elements and the circuit board. The lighting elements and the main body are fixed to the housing by the main body cooperative with the fixing member.

Preferably, the housing forms a mounting portion for the fixing member, the mounting portion defines a second longitudinal axis parallel to the first longitudinal axis, the main body has a first cover substantially sleeved on the housing and a second cover permitting light illuminated from the plurality of lighting elements to pass there-through, the fixing member passes through the second cover and engages in the mounting portion, so as to fix the first cover, the second cover, the lighting element and the circuit board to the housing.

Preferably, the fixing member defines a third longitudinal axis, the second longitudinal axis and the third longitudinal axis are positioned in the same axis, the first cover forms a plurality of stop portions arranged along a radial direction of the first longitudinal axis and extends towards the direction of the first longitudinal axis, the first cover defines a plurality of grooves arranged along a radial direction of the first longitudinal axis and extends towards a direction that is away from the direction of the first longitudinal axis, the first cover further includes a first end distal from the housing portion and a second end mounted on the second housing portion, the first end forms an end surface; the second cover forms a plurality of restricting portions corresponding to the plurality of stop portions, a plurality of protrusions corresponding to the plurality of grooves, and an outer surface positioned adjacent to the end surface, the plurality of restricting portions are arranged along a radial direction of the first longitudinal axis and extend away from the direction of the first longitudinal axis, and are prevented from moving along the first longitudinal axis by the stop portions, the plurality of protrusions are arranged along a radial direction of the first longitudinal axis, and extend away from the direction of the first longitudinal axis, the plurality of protrusions extend through the plurality of grooves.

Preferably, the plurality of lighting elements are three LEDs evenly distributed around the first longitudinal axis, the at least one fixing member are two screws, the second cover forms three receiving portions for respectively receiving lighting elements and defines two through holes, each screw passes through one of the through holes, the receiving portions are transparent and permit light illuminated from the lighting elements to pass there-through.

Preferably, the illuminating assembly further comprises a shock-absorbing element positioned between the housing and the circuit board or between the main body and the circuit board.

Furthermore, the hand-held power tool includes a motor, an execution element, an output shaft for driving the execution element, a transmission mechanism for transmitting the rotary power of the motor to the output shaft, and a main circuit board for controlling the motor. The housing includes a first housing portion for receiving the motor, a second housing portion for receiving the transmission mechanism, and a third housing portion for a user to hold; the third housing portion defines a fourth longitudinal axis substantially perpendicular to the first longitudinal axis, the illuminating assembly further comprising a wire and a wire guide, the wire includes a first end electrically connected to the circuit board and second end opposite to the first end electrically connected to the main circuit board, the wire guide includes a first guide portion and a second guide portion, the wire passes the first guide portion to extend through the second housing portion and being guided by the second guide portion.

Preferably, the first guide portion is positioned in the first cover or in the second housing portion, the second guide section is positioned in the first housing portion or in the second housing portion, the first guide portion is located in or above a plane that the first longitudinal axis is positioned in and the plane is perpendicular to the fourth longitudinal axis, the second guide portion extends along a circumferential direction of the first longitudinal axis.

Preferably, the hand-held power tool further includes a heat insulating member between the second housing portion and the wire.

Preferably, the hand-held power tool further includes a battery pack, wherein at least one of the lighting elements is capable of indicating whether the battery pack has a sufficient power source, when the battery pack has an insufficient power source, the at least one of the lighting elements is capable of producing an alarm signal that a human can perceive.

Preferably, the output shaft extends through the first cover and the second cover, the second cover covering the gap between first cover and second housing portion.

Since the lighting elements are distributed around the first longitudinal axis, light of the lighting elements can be emitted from multiple different angles, shadows are avoided in corresponding zones, and therefore the lighting elements can be called shadow-less lighting elements.

DETAILED DESCRIPTION

With reference to the figures, the present disclosure provides a hand-held power tool with an illuminating feature. The hand-held power tool may be an electric motor driven tool or pneumatic motor-driven tool. The hand-held power tool may also be a drill, a screwdriver, a wrench, a circular saw, a reciprocating saw or an electric hammer. In the following illustrated embodiment, an electric motor-driven impact wrench is taken as an example for the detailed description.

Figure 1:
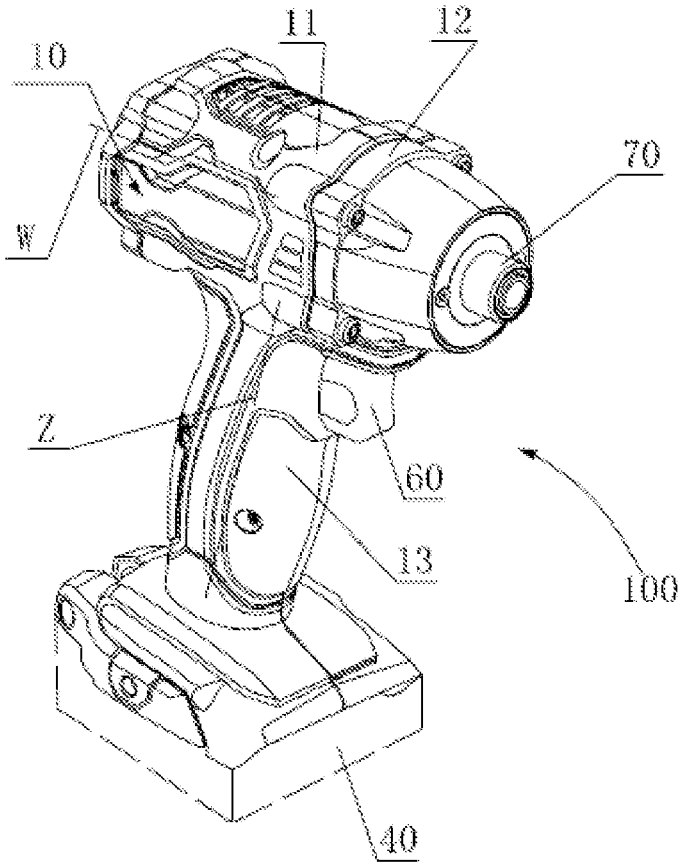
FIG. 1 is a schematic, perspective view of a hand-held power tool of the present disclosure.
Figure 2:
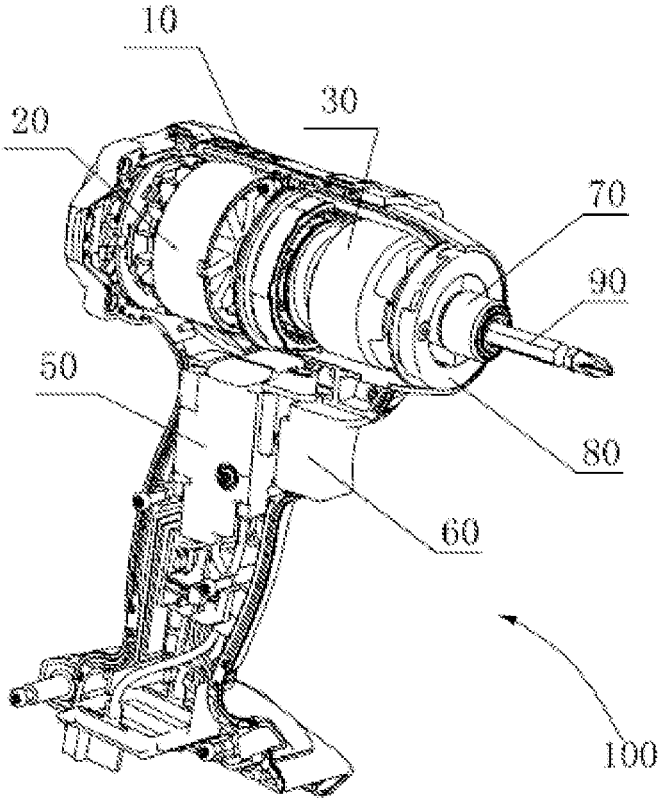
FIG. 2 is a schematic, perspective view of the hand-held power tool of FIG. 1 when a half housing portion is removed.
Figure 3:
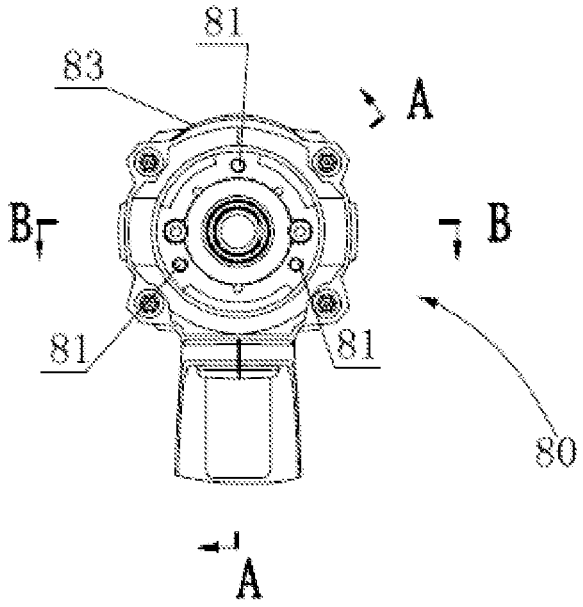
FIG. 3 is a schematic, front view of the hand-held power tool of FIG. 1, showing an illuminating assembly.
Figure 4:
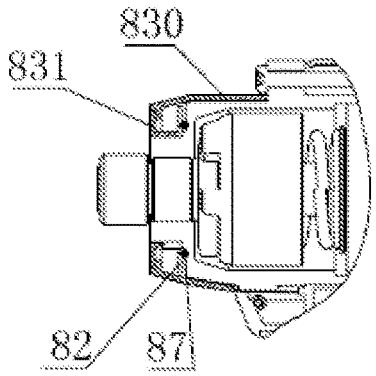
FIG. 4 is a cross-sectional view of FIG. 3 along line A-A.
Figure 5:
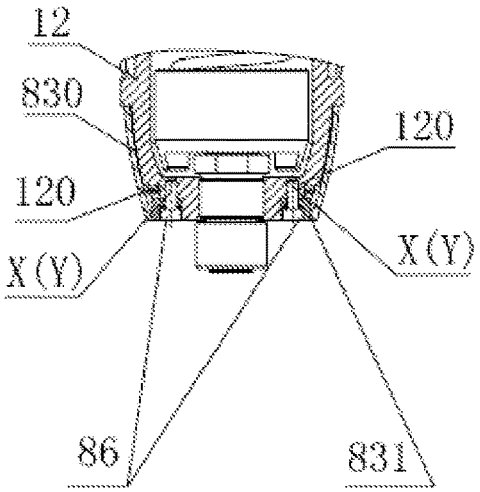
FIG. 5 is a cross-sectional view of FIG. 3 line B-B.
Figure 6:
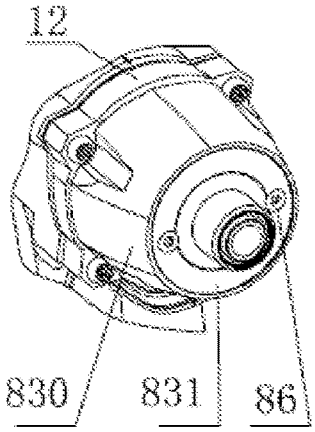
FIG. 6 is a schematic, perspective view of the illuminating assembly of FIG. 1.
Figure 7:
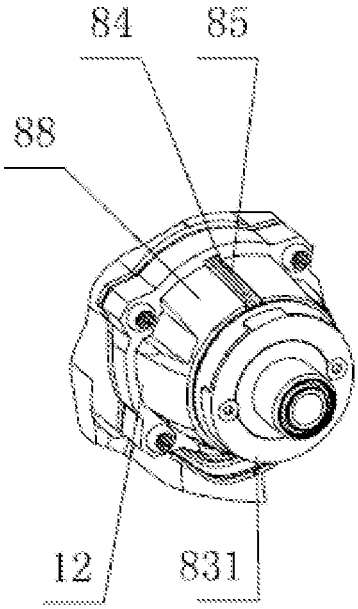
FIG. 7 is a schematic, perspective view of the illuminating assembly in FIG. 6, when a first cover of the illuminating assembly is removed.
Figure 8:
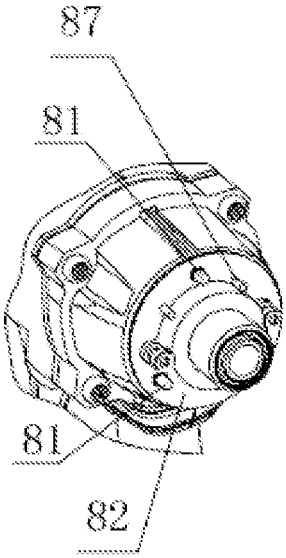
FIG. 8 is a schematic, perspective view of the illuminating assembly in FIG. 7, when a second cover of the illuminating assembly is further removed.
Figure 9:
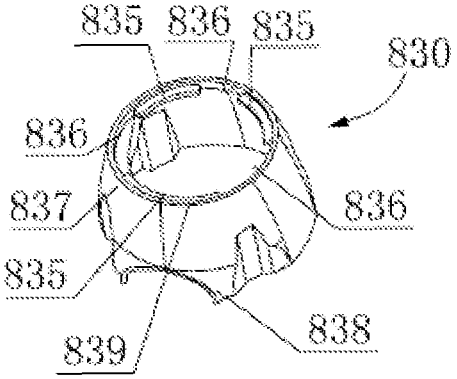
FIG. 9 is a schematic, perspective view of the first cover of the illuminating assembly.
Figure 10:
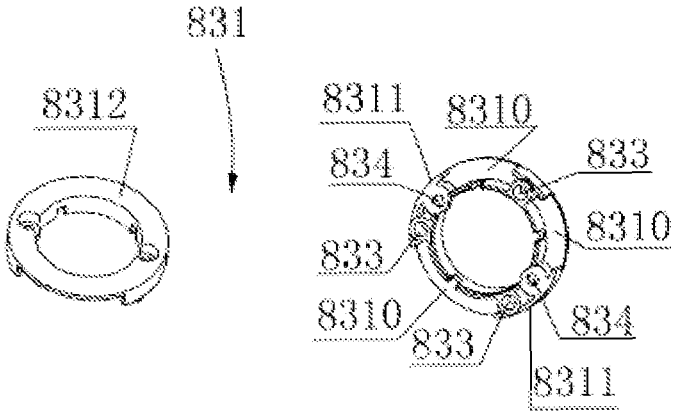
FIG. 10 is a schematic, perspective view of the second cover of the illuminating assembly.
Figure 11:
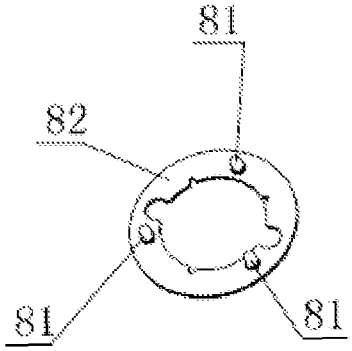
FIG. 11 is a schematic, assembled view of a lighting element and a circuit board of the illuminating assembly.

Referring to FIGS. 1 and 2, a hand-held power tool 100 includes a housing 10, a motor 20 and a transmission mechanism 30 received in the housing 10, a power source 40 for providing power to the motor, a switch 50 received in the housing for controlling the motor 20, a trigger 60 for activating or cutting off the switch 50, an output shaft 70, an illuminating assembly 80, and an execution element 90. The transmission mechanism 30 transmits the rotary power of the motor 20 to the output shaft 70. The output shaft 70 drives the execution element 90. The illuminating assembly 80 is used to illuminate the execution element 90 or a work-piece, and it is convenient for the users to clearly see the position of the execution element 90.

The housing 10 includes a first housing portion 11 for receiving the motor 20, a second housing portion 12 for receiving the transmission mechanism 30, and a third housing portion 13 for receiving the switch 50. The first housing portion 11 defines a first longitudinal axis W. The second housing portion 12 is fixed to the first housing portion 11. It should be noted that, the first housing portion 11 and the second housing portion 12 may be integrally made. Preferably, the second housing portion 12 and the second housing portion 12 are made of a different material, for example, the first housing portion 11 is made of plastic and the second housing portion is made of metal material. In the illustrated example, the first housing portion 11 is made with nylon and the second housing portion 12 is made of aluminum alloy. The first housing portion 11 includes two half shell assembled to each other. The second housing portion 12 is made by die-casting or other manufacturing process. The first housing portion 11 and the second housing portion 12 are mutually fixed by a fixing element. The third housing portion 13 forms a gripping portion for facilitating a user to hold the hand-held power tool 100. Of course, it should be noted that, a gripping portion may also be formed on the first housing portion 11 or the second housing portion 12 for a user to hold. One end of the third housing portion 13 is connected to the first housing portion 11 and second housing portion 12. Another end of the third housing portion 13 may be formed or fixed with an engaging structure (not labeled) for mounting the power source 40.

The motor 20 may be an electric motor or pneumatic motor. In the illustrated embodiment, the motor 20 is an electric motor.

The transmission mechanism 30 transmits the rotary motion of the motor to the output shaft 70. The transmission mechanism 30 is a well-known structure in an impact wrench, such as the transmission mechanism described in the U.S. Pat. No. 6,733,414B2.

The power source 40 may be a direct current power supply, a battery pack or an AC power source. In the illustrated embodiment, the power source 40 is a battery pack for providing direct current power.

The switch 50 may be used for controlling the motor 20 to start and stop. If necessary, the switch 50 may control the rotating direction and speed of the motor 20. The trigger 60 is installed in the third housing portion 13. The user is capable of adjusting the rotating speed of the motor 20 by adjusting the amount of pressing upon the trigger 60. The trigger 60 may further include a reversing knob for adjusting the rotating direction of the motor 20.

The execution element 90 is mounted on the output shaft 70 by a clamping assembly (not labeled). The illuminating assembly 80 helps the user to clearly see the position of the execution element 90 or of the work-piece machined by the execution element 90.

Referring to FIGS. 3-13, in the following section, the illumination assembly 80 will be illustrated in detail.

The illuminating assembly 80 is mounted on the housing 10 and includes a plurality of lighting elements 81, a circuit board 82 electrically connected with the lighting element 81, a main body 83 covering the lighting element 81 and the circuit board 82, a wire 84, a wire guide 85, and fixing members 86. The circuit board 82 is capable of supporting the lighting elements 81. The main body 83 permits the light illuminating from the lighting element 81 to pass there-through. The lighting element 81 and the circuit board 82 are fixed to the second housing portion 12 by the main body 83 cooperative with the fixing members 86. The plurality of lighting elements 81 are evenly distributed on the housing 10 around the first longitudinal axis W, thus light can be illuminated from a plurality of different angles and preventing shadow from being formed on a corresponding region adjacent to the execution element 90. Therefore, such lighting elements 81 can also be referred to as shadow-less lighting elements.

Figure 12:
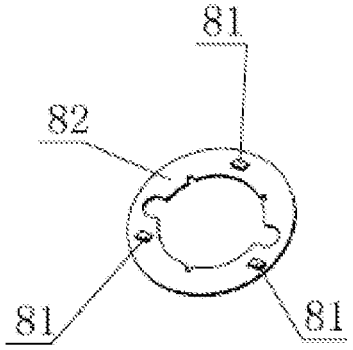
FIG. 12 is a further schematic, assembled view of a lighting element and a circuit board of an illuminating assembly.
Figure 13:
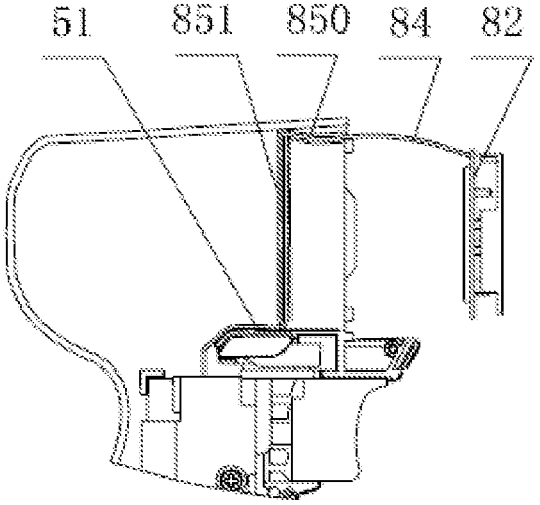
FIG. 13 is a schematic view of a wire and a wire guide of the illuminating assembly.

In one embodiment, the lighting elements 81 are three Pin type LEDs evenly distributed around the first longitudinal axis. The main body 83 includes a first cover 830 having a substantial portion that is sleeved on the housing 10 and a second cover 831 for light illuminated from the lighting elements 81 to pass there-through. The fixing members 86 are two screws. The second cover 831 forms three receiving portions 833 for respectively receiving lighting elements 81 and defines two through holes 834. Each fixing members 86 is capable of passing through one of the through holes 834. The receiving portions 833 are transparent and permit light illuminated from the lighting elements 81 to pass there-through. The first cover 830 and second cover 831 may be both or only one made of transparent material. The first cover 830 and second cover 831 may also be integrally formed. In another embodiment, as shown in FIG. 12, the lighting elements 81 may be three patch type LEDs evenly distributed around the first longitudinal axis, thereby further decreasing occupied space of the lighting element 81 and the circuit board 82. It should be noted that, light emitting from the lighting elements 81 may not pass through the main body 83, thus the lighting element 81 and a circuit board 82 are partially received in the main body 83, and a predetermined portion of the lighting elements 82 where light is emitted is outside the main body 83.

When the first cover 830 and the second cover 831 are separate parts, the second housing portion 12 forms a mounting portion 120 for receiving the fixing members 86. The mounting portion 120 defines a second longitudinal axis X parallel to the first longitudinal axis W. The fixing members 86 pass through the second cover 831 to fix the first cover 830, the second cover 831, the lighting element 81 and the circuit board 82 to the second housing portion 12. Therefore, the lighting elements 81 are compactly fixed to the second housing portion 12.

Each fixing member 86 defines a third longitudinal axis Y. The second longitudinal axis X and third longitudinal axis are positioned in the same axis. The first cover 830 forms a plurality of stop portions 835 arranged along a radial direction of the first longitudinal axis W and extending towards the direction of the first longitudinal axis W, and defines a plurality of grooves 836 arranged along a radial direction of the first longitudinal axis W and extending towards a direction away from the direction of the first longitudinal axis W. The first cover 830 further includes a first end 837 distal from the second housing portion 12 and a second end 838 mounted on the second housing portion 12. The stop portion 835 is used for preventing the second cover 831 from moving along the first longitudinal axis. The first end 837 forms an end surface 839. The second cover forms a plurality of restricting portions 8310, a plurality of protrusions 8311, and an outer surface 8312 positioned adjacent to the end surface 839. The restricting portions 8310 are arranged along a radial direction of the first longitudinal axis W, and extend away from the direction of the first longitudinal axis W, and are prevented from moving along the first longitudinal axis W by the stop portions 835. The protrusions 8311 are arranged along a radial direction of the first longitudinal axis W, and extend away from the direction of the first longitudinal axis W. The protrusions 8311 are capable of extending through the grooves 836. In order to cover the circuit board 82 and get a beautiful appearance, the output shaft 70 should extend through the first cover 830 and the second cover 831, the second cover 831 is used for covering the gap between first cover 830 and second housing portion 12.

When the hand-held power tool 100 is an impact wrench, relatively high vibrations are generally caused in the operating process. In order to prevent these vibrations from damaging the lighting elements 81 or the circuit board 82, the illuminating assembly 80 further includes a shock-absorbing element 87 positioned between the second housing portion 12 and the circuit board 83. It should be noted that the shock-absorbing element 87 may also be positioned between the main body 83 and the circuit board 82. In one embodiment, the shock-absorbing element 87 is an elastic O-ring positioned on the circuit board 82 and the second housing portion 12. The shock-absorbing element 87 may also be a plurality of rubber columns arranged between the circuit board 82 and the main body 83.

In order to make the hand-held power tool 100 more compact, the circuit board 82 at the front end is electrically connected to a main circuit board 51 of the hand-held power tool 100 by the wire 84, so that the lighting element 81 is provided power from a battery pack of the hand-held power tool 100. It should be noted that the lighting element 81 can also get power from an independent power supply, such as a button battery mounted in the housing 11. Furthermore, in order to prevent oil in the transmission mechanism 30 from contaminating the wire 84, the third housing portion 13 defines a fourth longitudinal axis Z substantially perpendicular to the first longitudinal axis W. The wire 84 includes a first end electrically connected to the circuit board 82, and a second end opposite to the first end electrically connected to the main circuit board 51. The wire guide 85 includes a first guide portion 850 and a second guide portion 851. The second guide portion 851 is positioned between the first housing portion 11 and the second housing portion 12. The wire 84 passes the first guide portion 850 to extend through the second housing portion 12 and is guided by the second guide portion 851.

Preferably, the first guide portion 850 is positioned in the first cover 830 or in the second housing portion 12. The second guide section 851 is positioned in the first housing portion 11 or in the second housing portion 12. The second housing portion 12 may be partially received in the first housing portion. The first guide portion 850 is located in or above a plane that the first longitudinal axis W is positioned in and the plane is perpendicular to the fourth longitudinal axis Z. The second guide portion 851 extends along a circumferential direction of the first longitudinal axis W. The first guide portion 850 may be integrally formed with the first cover 830 or the second housing portion 12. The first guide portion 850 may also be a separate element fixed to the first cover 830 or the second housing portion 12. The wire guide 85 effectively avoids the wire 84 being contaminated by oil in the transmission mechanism 30. In addition, the first guide portion 850 is located in or above the plane including the first longitudinal axis and perpendicular to the fourth longitudinal axis Z, thus the whole structure of the hand-held power tool 100 becomes more compact. If the first guide portion 850 is positioned below the plane, the whole structure of the hand-held power tool 100 may become larger, in particular, a finger holding area between the trigger 60 and the second housing portion 12 becomes larger, thus causing it to be difficult to hold in the finger platform region.

If the second housing portion 12 is made of metallic material and the power tool 100 is an impact wrench, after a relatively long time operation, a great amount of heat may be generated on the second housing portion 12. Therefore, the power tool 100 further includes a heat insulating member 88 made of high-temperature-resistant material, and the heat insulating member 88 is positioned between the second housing portion 12 and the wire 84 for isolating heat and effectively protecting the wire. Thus, the wire 84 is effectively prevented from overheating and failure. In another embodiment, an insulating layer of the wire 84 is made of a high-temperature material. Preferably, the heat insulating member 88 is made of heat shrinkable sleeve or yellow wax tubes.

Figure 14:
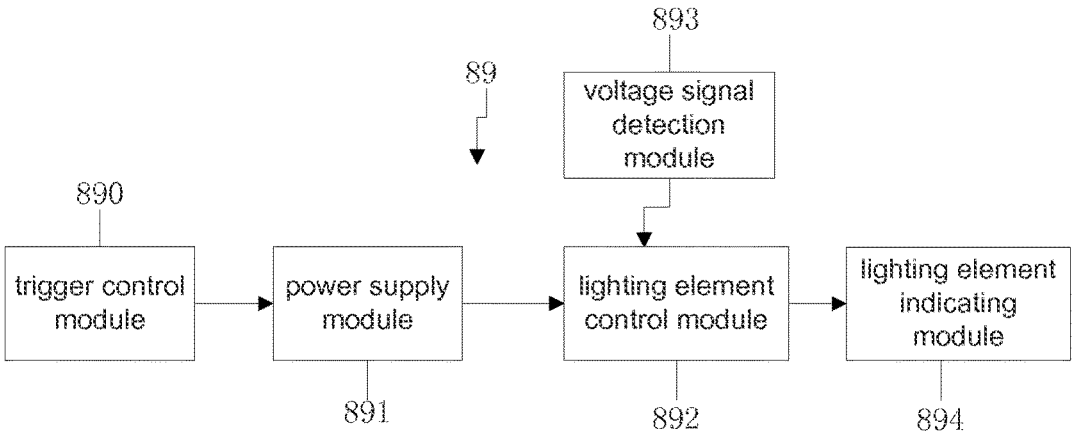
FIG. 14 is a logic diagram of an indicating circuit of the illuminating assembly for showing remaining capacity of a battery pack of hand-held power tool.
Figure 15:
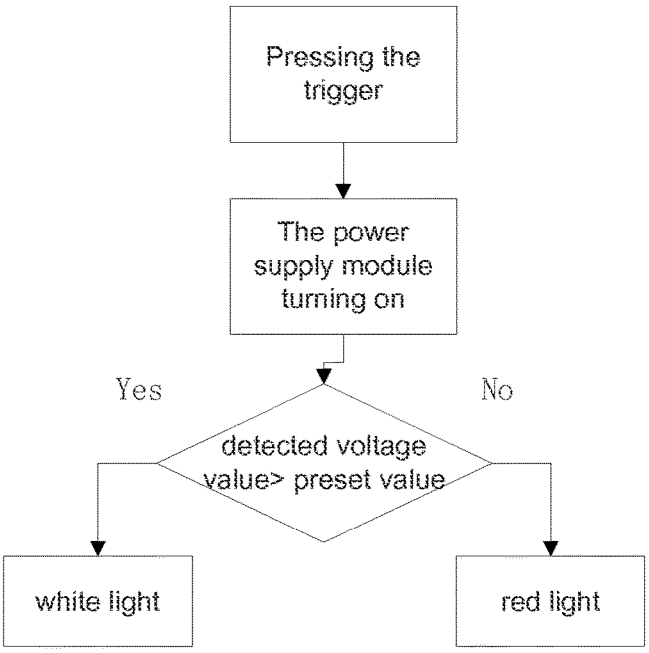
FIG. 15 is a logic diagram of a control method of the indicating circuit for showing remaining capacity of a battery pack of hand-held power tool.
Figure 16:
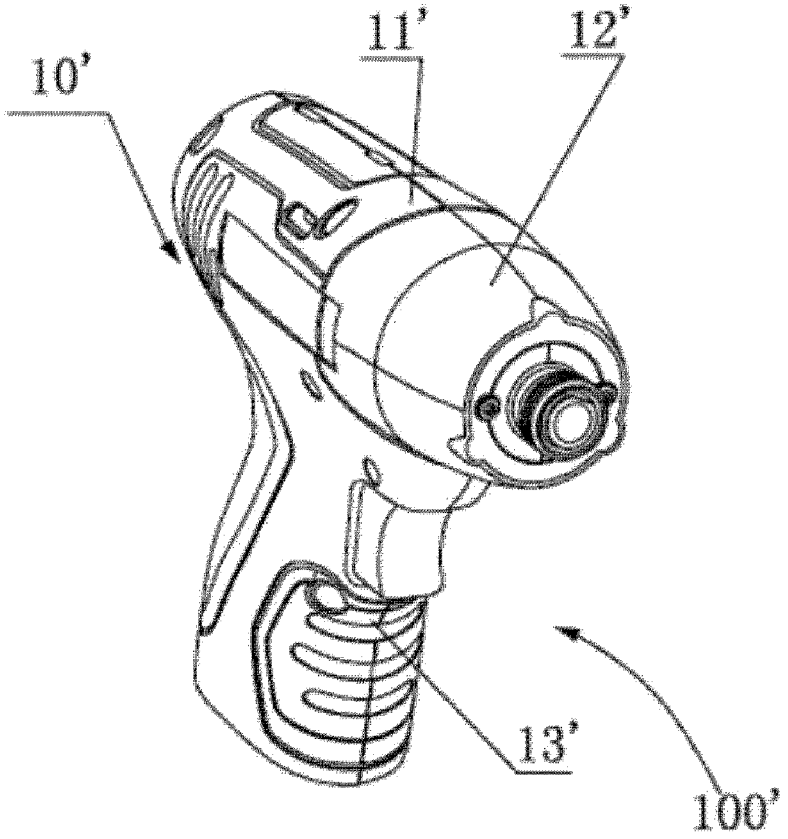
FIG. 16 is a schematic, perspective view of a second embodiment of a hand-held power tool of the present disclosure.
Figure 17:
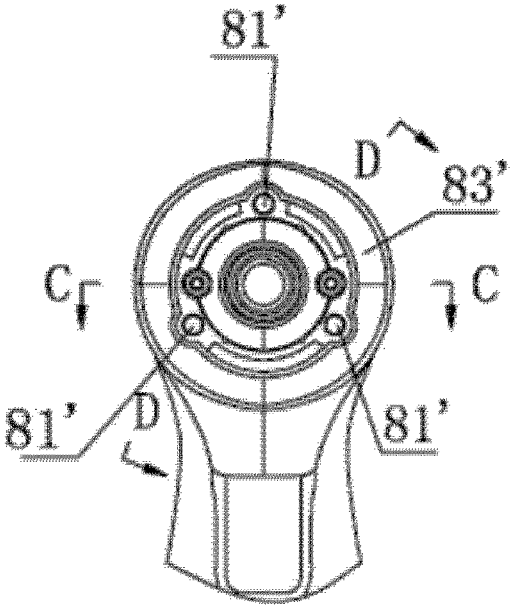
FIG. 17 is a schematic, plan view of an illuminating assembly of hand-held power tool in FIG. 16.
Figure 18:
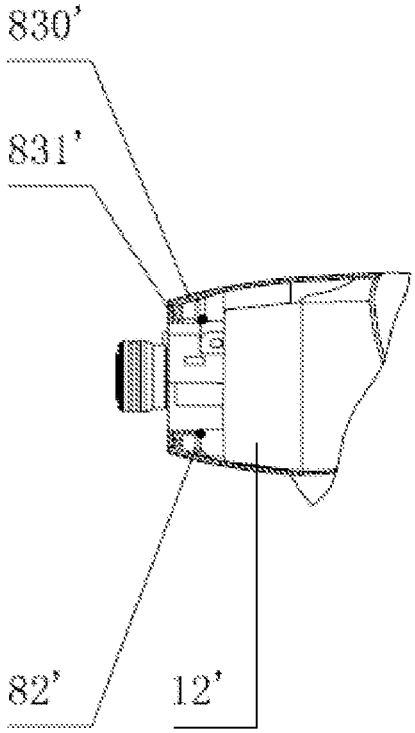
FIG. 18 is a cross-sectional view of FIG. 17 along line C-C.
Figure 19:
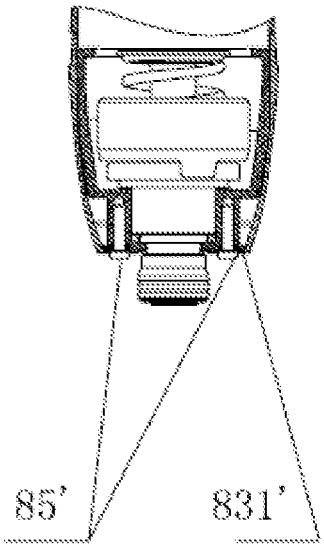
FIG. 19 is a cross-sectional view of FIG. 17 along line D-D.
Figure 20:
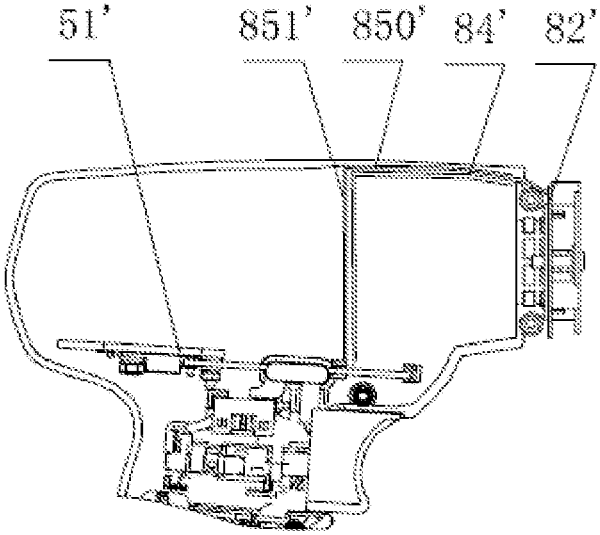
FIG. 20 is a further schematic, plan view of a wire and a wire guide of an illuminating assembly.

The lighting elements 81 may also be used for indicating insufficiency of remaining capacity of the battery pack. At least one lighting element is used for indicating whether the battery pack has a sufficient power source. When the battery pack has an insufficient power source, at least one of the lighting elements produces an alarm signal that a human can perceive. Referring to FIGS. 14 and 15, an indicating circuit 89 for showing insufficiency of remaining capacity of the battery pack includes a trigger control module 890, a power supply module 891, lighting element control module 892, voltage signal detection module 893 and lighting element indicating module 894. A user switches the trigger control module 890 so that the power supply module 891 can provide energy to the lighting element control module 892. A voltage signal detected by the voltage signal detection module 893 is compared to a preset voltage in the battery pack, when the detected voltage value is greater than the preset voltage value, the lighting elements 81 display white light, when the detected voltage value is lower than the preset voltage value, the lighting element 81 display red light. It should be noted that, the lighting element 81 can emit other human perceptible signal, such as make lighting element 81 flash, or a buzzer is arranged additionally, when the insufficient power source is detected, the buzzer alarms.

As shown in FIGS. 16-20, a second embodiment of the present disclosure provides a hand-held power tool 100', an electric motor-driven impact wrench is still taken as an example for the following detailed description.

The hand-held power tool 100' in the second embodiment is similar to the hand-held power tool 100 in the first embodiment. The hand-held power tool 100' also includes a first housing portion including 11', a second housing portion 12', a second housing portion 13' and an illuminating assembly 80'. However, each of the first housing portion including 11', the second housing portion 12', and the second housing portion 13' includes two half housing portions.

Furthermore, the illuminating assembly 80 is positioned on the second housing portion 12' and includes a lighting element 81', a circuit board 82', a main body 83', a wire 84', a wire guide 85' and fixing members 86'. The lighting element 81' is mounted on the circuit board 82'. The main body 83' permits the light illuminated by the lighting element 81 to pass there-through. The lighting element 81 and the circuit board 82 are covered by the main body 83'. The circuit board 82' is electrically connected to a main circuit board 51' by the wire 84'. The wire guide 85' includes a first guide portion 850' positioned on the second housing portion 850' and second guide portion 851' positioned on the second housing portion. The main body 83' includes a first cover 830' and a second cover 831'. The first cover 830' and the second cover 831' are fixed to the second housing portion 12' by the fixing member 86'.

When the text of the connection relations referred to in terms, such as "connected", "fixed" and "received" and the like, it can be understood as one of the elements is directly connected to, fixed to or received in another element. It can also be understood as one of the elements is indirectly connected to, fixed to or received in another element by a third element or more elements.

The above illustrates and describes basic principles, main features and advantages of the present disclosure. Those skilled in the art should appreciate that the above embodiments do not limit the present disclosure in any form. Rather, technical solutions obtained in a way of equivalent substitution or equivalent variations are all intended to fall within the scope of the claims set forth hereinafter.

What is claimed is:

1. A hand-held power tool, comprising:

a housing defining a first longitudinal axis; and an illuminating assembly mounted to the housing, the illuminating assembly comprising:

a plurality of lighting elements distributed on the housing around the first longitudinal axis;

a circuit board electrically connected to the lighting elements, and the lighting elements being supported by the circuit board;

a main body at least partially covering the lighting elements and the circuit board; and at least one fixing member wherein the plurality of lighting elements and the main body are fixed to the housing by the main body cooperative with the at least one fixing member, wherein the housing forms a mounting portion for the fixing member, the mounting portion defines a second longitudinal axis parallel to the first longitudinal axis, the main body has a first cover substantially sleeved on the housing and a second cover permitting light illuminated from the plurality of lighting elements to pass there-through wherein the fixing member passes through the second cover and engages in the mounting portion, so as to fix the first cover, the second cover, the lighting element and the circuit board to the housing.

2. The hand-held power tool according to claim 1, wherein the fixing member defines a third longitudinal axis, the second longitudinal axis and the third longitudinal axis are positioned in a same axis, the first cover forms a plurality of stop portions that are arranged along a radial direction of the first longitudinal axis and which extend towards the direction of the first longitudinal axis, the first cover defines a plurality of grooves arranged along a radial direction of the first longitudinal axis and which extend towards a direction that is away from a direction of the first longitudinal axis, the first cover further includes a first end away from the housing portion and a second end mounted on the second housing portion, the first end forms an end surface, the second cover forms a plurality of restricting portions corresponding to the plurality of stop portions, a plurality of protrusions corresponding to the plurality of grooves, and an outer surface positioned adjacent to the end surface, the plurality of restricting portions are arranged along a radial direction of the first longitudinal axis and extend away from the direction of the first longitudinal axis and are prevented from moving along the first longitudinal axis by the stop portions, the plurality of protrusions are arranged along a radial direction of the first longitudinal axis and extend away from the direction of the first longitudinal axis and wherein the plurality of protrusions extend through the plurality of grooves.

3. The hand-held power tool according to claim 2, wherein the plurality of lighting elements are three LEDs evenly distributed around the first longitudinal axis, the at least one fixing member are two screws, the second cover forms three receiving portions for respectively receiving lighting elements and defines two through holes, each screw passes through one of the through holes, the receiving portions are transparent and permit light illuminated from the lighting elements to pass there-through.

4. The hand-held power tool according to claim 1, wherein the illuminating assembly further comprises a shock-absorbing element positioned between the housing and the circuit board or between the main body and the circuit board.

5. The hand-held power tool according to claim 1, further comprising:

a motor;

an execution element;

an output shaft for driving the execution element;

a transmission mechanism for transmitting the rotary power of the motor to the output shaft; and a main circuit board for controlling the motor, the housing comprising a first housing portion for receiving the motor, a second housing portion for receiving the transmission mechanism, and a third housing portion for a user to hold, the third housing portion defining a fourth longitudinal axis substantially perpendicular to the first longitudinal axis, the illuminating assembly further comprising a wire and a wire guide, the wire including a first end electrically connected to the circuit board and a second end opposite to the first end electrically connected to the main circuit board, the wire guide comprising a first guide portion and a second guide portion, the wire passing the first guide portion to extend through the second housing portion and being guided by the second guide portion.

6. The hand-held power tool according to claim 5, wherein the first guide portion is positioned in the first cover or in the second housing portion, the second guide section is positioned in the first housing portion or in the second housing portion, the first guide portion is located in or above a plane that the first longitudinal axis is positioned in and the plane is perpendicular to the fourth longitudinal axis, and the second guide portion extends along a circumferential direction of the first longitudinal axis.

7. The hand-held power tool according to claim 5, further comprising a heat insulating member disposed between the second housing portion and the wire.

8. The hand-held power tool according to claim 5, further comprising a battery pack, wherein at least one of the lighting elements is capable of indicating whether the battery pack has a sufficient power source, when the battery pack has an insufficient power source, the at least one of the lighting elements is capable of producing an alarm signal that a human can perceive.

9. The hand-held power tool according to claim 5, wherein the output shaft extends through the first cover and the second cover, the second cover covering the gap between first cover and second housing portion.

10. A hand-held power tool, comprising:

a housing defining a first longitudinal axis;

a motor received in the housing;

an execution element;

an output shaft for driving the execution element;

a transmission mechanism for transmitting the rotary power of the motor to the output shaft;

an illuminating assembly mounted to the housing, the illuminating assembly comprising:

a plurality of lighting elements distributed on the housing around the first longitudinal axis;

a circuit board electrically connected to the lighting elements, and the lighting elements being supported by the circuit board;

a main body at least partially covering the lighting elements and the circuit board; and at least one fixing member wherein the plurality of lighting elements and the main body are fixed to the housing by the main body cooperative with the at least one fixing member; and a battery pack for providing power source to the motor and the plurality of lighting elements, at least one of the plurality of lighting elements function to indicate whether the battery pack has a sufficient power source and produce an alarm signal that a human can perceive when the battery pack has an insufficient power source, wherein the housing forms a mounting portion for the fixing member, the mounting portion defines a second longitudinal axis parallel to the first longitudinal axis, the main body has a first cover substantially sleeved on the housing and a second cover permitting light illuminated from the plurality of lighting elements to pass there-through wherein the fixing member passes through the second cover and engages in the mounting portion, so as to fix the first cover, the second cover, the lighting element and the circuit board to the housing.

11. The hand-held power tool according to claim 10, wherein the fixing member defines a third longitudinal axis, the second longitudinal axis and the third longitudinal axis are positioned in a same axis, the first cover forms a plurality of stop portions arranged along a radial direction of the first longitudinal axis and which extend towards the direction of the first longitudinal axis, the first cover defines a plurality of grooves arranged along a radial direction of the first longitudinal axis and which extend towards a direction away from the direction of the first longitudinal axis, the first cover further includes a first end distal from the housing portion and a second end mounted on the second housing portion, the first end forms an end surface, the second cover forms a plurality of restricting portions corresponding to the plurality of stop portions, a plurality of protrusions corresponding to the plurality of grooves, and an outer surface positioned adjacent to the end surface, the plurality of restricting portions are arranged along a radial direction of the first longitudinal axis and extend away from the direction of the first longitudinal axis, and are prevented from moving along the first longitudinal axis by the stop portions, the plurality of protrusions are arranged along a radial direction of the first longitudinal axis, and extend away from the direction of the first longitudinal axis, the plurality of protrusions extend through the plurality of grooves.

12. The hand-held power tool according to claim 11, wherein the plurality of lighting elements are three LEDs evenly distributed around the first longitudinal axis, the at least one fixing member are two screws, the second cover forms three receiving portions for respectively receiving lighting elements and defines two through holes, each screw passes through one of the through holes, and the receiving portions are transparent and permit light illuminated from the lighting elements to pass there-through.

13. The hand-held power tool according to claim 10, wherein the illuminating assembly further comprises a shock-absorbing element positioned between the housing and the circuit board or between the main body and the circuit board.

* * * * *